US009617939B2

(12) United States Patent
Ravenda

(10) Patent No.: US 9,617,939 B2
(45) Date of Patent: Apr. 11, 2017

(54) PINTLE VELOCITY DETERMINATION IN A SOLENOID FUEL INJECTOR AND CONTROL METHOD

(71) Applicant: DELPHI AUTOMOTIVE SYSTEMS LUXEMBOURG SA, Bascharage (LU)

(72) Inventor: Francois Ravenda, Longwy (FR)

(73) Assignee: Delphi Automotive Systems Luxembourg SA, Luxembourg (LU)

( * ) Notice: Subject to any disclaimer, the term of this patent is extended or adjusted under 35 U.S.C. 154(b) by 232 days.

(21) Appl. No.: 14/346,019

(22) PCT Filed: Sep. 20, 2012

(86) PCT No.: PCT/EP2012/068546

§ 371 (c)(1),
(2) Date: Mar. 20, 2014

(87) PCT Pub. No.: WO2013/045342

PCT Pub. Date: Apr. 4, 2013

(65) Prior Publication Data

US 2015/0040871 A1 Feb. 12, 2015

(30) Foreign Application Priority Data

Sep. 30, 2011 (EP) ..... 11183403

(51) Int. Cl.
*F02D 41/20* (2006.01)

(52) U.S. Cl.
CPC ..... *F02D 41/20* (2013.01); *F02D 2041/2027* (2013.01); *F02D 2041/2037* (2013.01);
(Continued)

(58) Field of Classification Search
CPC ..... F02D 41/20; F02D 2041/2062; F02D 2041/2037; F02D 2041/2027; F02D 2041/2058
(Continued)

(56) References Cited

U.S. PATENT DOCUMENTS 3,942,366 A * 3/1976 Hofmann ..... F02M 65/005 123/445
4,791,809 A * 12/1988 Schmidt ..... F02D 35/0007 123/478
(Continued)

FOREIGN PATENT DOCUMENTS

DE 10220388 A1 11/2002
DE 10235196 A1 2/2004
(Continued)

OTHER PUBLICATIONS

International Search Report Dated Oct. 24, 2012.

*Primary Examiner* — Joseph Dallo
(74) *Attorney, Agent, or Firm* — Joshua M. Haines

(57) ABSTRACT

A method is provided for determining the velocity of a pintle assembly in a solenoid fuel injector during a closing stroke of the pintle assembly, such that a braking step is performed during the closing stroke, which includes operating an injector driver with a current regulator to establish a braking current in the solenoid coil. The velocity of the pintle assembly is derived from the duty-cycle of the current regulator during the braking step. A method of operating a solenoid fuel injector, in particular for gaseous fuel, using the so-determined pintle velocity is also provided.

19 Claims, 3 Drawing Sheets

(52) U.S. Cl.
CPC ..... *F02D 2041/2058* (2013.01); *F02D 2041/2062* (2013.01)

(58) Field of Classification Search
USPC ..... 123/480, 490, 494, 357, 500, 501, 456; 73/119 A, 49.7, 119, DIG. 3; 239/73
See application file for complete search history.

(56) References Cited

U.S. PATENT DOCUMENTS 5,069,064 A * 12/1991 Wolff ..... F02M 65/005 73/114.47
5,282,570 A * 2/1994 Johnson ..... F02M 65/005 239/5
5,621,160 A * 4/1997 Carroll, III ..... F02M 65/00 701/103
5,996,557 A * 12/1999 Muraki ..... F02D 41/401 123/458
6,305,355 B1 * 10/2001 Hoffmann ..... F02M 47/027 123/458
6,513,502 B1 * 2/2003 Sunwoo ..... F02D 41/20 123/456
6,655,328 B2 * 12/2003 Kather ..... F01L 9/04 123/90.11
6,976,389 B2 * 12/2005 Farth ..... F02M 65/00 73/114.51
7,216,630 B2 * 5/2007 Martin ..... F02M 45/04 123/467
8,128,004 B2 * 3/2012 Koch ..... G05B 13/021 239/5
8,833,342 B2 * 9/2014 Richter ..... F02D 41/20 123/446
2003/0066500 A1 * 4/2003 Kather ..... F01L 9/04 123/90.11
2008/0087239 A1 * 4/2008 Wiley ..... F01L 1/18 123/90.16
2010/0043758 A1 * 2/2010 Caley ..... F02M 21/0254 123/490
2011/0315124 A1 * 12/2011 Richter ..... F02D 41/20 123/480
2012/0012086 A1 * 1/2012 Yoeda ..... F02B 29/083 123/559.1

FOREIGN PATENT DOCUMENTS

WO 2010 056111 A1 5/2010
WO 2010 079027 A1 7/2010

* cited by examiner

PINTLE VELOCITY DETERMINATION IN A SOLENOID FUEL INJECTOR AND CONTROL METHOD

FIELD OF THE INVENTION

The present invention generally relates to the control of solenoid fuel injectors and more particularly to the determination of the pintle velocity of a solenoid fuel injector to enable an improved control.

BACKGROUND OF THE INVENTION

Solenoid fuel injectors are commonly used in internal combustion engines. As it is well known, in solenoid actuated fuel injectors a solenoid coil is associated with a pintle assembly that cooperates with an outlet orifice at the injector tip to open or close the latter. The injector is configured such that when the solenoid coil is energized, it generates a magnetic field that allows lifting the pintle off its sealing seat at the injector tip, and thus causes the flow of fuel through the outlet orifice. When the solenoid coil is de-energized, the pintle assembly returns onto its seat under the action of a return spring and pressure acting thereon.

Modern developments of solenoid fuel injectors have led to high switching speeds. But the downside thereof is high impact velocities of the needle assembly on the valve seat, which causes noise, wear and fatigue, as well as bouncing of the pintle assembly at closing.

Pintle bouncing is particularly critical as it causes multiple parasitic injections, which reduce injection precision and deteriorates emission and efficiency. This contrasts with current and future emission legislation limits together with the demand for low fuel consumption that hence implies a more effective combustion in modern automotive engines.

Besides, in some uses, for example for gaseous fuel injection, wear of the valve seat due to needle impact is a major concern. Indeed, the wear phenomenon is more critical due too poor lubrication capabilities of gaseous fuels.

Nevertheless, improvements in the switching behavior of solenoid injectors, with shorter opening and closing times, by means of electronic control strategies show significant potential. Therefore, mechanical and electronic solutions have been developed to reduce bouncing.

Bouncing can be reduced by introducing hydraulic flow resistance into the fuel support. This leads to a limitation of upper injection volume per time and affects the final application. A controlled anti-force from the braking current in the coil after lift off can compensate excessive spring force and is able to almost completely eliminate bouncing. However, the system is sensitive to parameter variation, which makes it difficult to apply in practice.

Studies have shown that the major parameter affecting open-loop control of the braking current is fuel pressure. In this connection, it has been suggested that needle velocity information could be used as a parameter to determine optimum braking current parameters (such as trigger timing, duration, amplitude). This being said, it is desirable to have reliable means for determining needle velocity without any dedicated sensor.

OBJECT OF THE INVENTION

The object of the present invention is to provide a method of determining the pintle velocity in a fuel injector. This object is achieved by a method as claimed in claim 1.

A further object of the present invention is to provide a method of operating a fuel injector on the basis of the determined pintle velocity.

SUMMARY OF THE INVENTION

The present invention concerns a method of determining the velocity of a pintle assembly in a solenoid fuel injector during a closing stroke of the pintle assembly, following an opening stroke by which fuel is injected in the engine. A braking step is performed during the closing stroke in order to reduce the pintle speed towards its closed position and thereby reduce or avoid bouncing. During the braking step, an injector driver stage with current regulator is operated to establish a braking current in the solenoid coil.

The principle at the basis of the present method is to estimate or derive the speed of the pintle assembly during the braking stroke from the duty cycle of the current regulator during the braking step.

A merit of the present inventor is indeed to have observed that the motion of the pintle relative to the solenoid coil has an incidence on the duty cycle of the current regulator, and that a pintle velocity can be derived from the duty cycle information.

Within the context of the present invention, the "term current" regulator typically designates a device able to deliver a certain level of current and maintain it within an operating range corresponding to the desired current level. Such current regulators are typically based on chopping, i.e. the load is disconnected from the voltage source when the current reaches or exceeds an upper threshold, e.g. using a pulse-width modulation signal. Hence, the time when the voltage source is connected to the coil may be referred to as "on-time" and the time when the voltage source is disconnected from the voltage source is referred to as "off-time". The duty cycle then conventionally designates the total on-time over the duration of the braking pulse (i.e. on-time+off-time).

Especially, the present inventor has surprisingly found that a relationship exists between the regulator off-time and the velocity of the injector pintle. Monitoring the duration of off-time of the current regulator thus allows, relying on calibration, determining the velocity of the injector pintle. More specifically, it has been observed that during the braking pulse an extended off-time period occurs in the regulator, as compared to normal regulation. This can be readily observed by measuring the voltage of the injector, respectively across the solenoid coil, that collapses to zero during an extended time period.

The reason for this voltage collapse arises due to the displacement of the pintle assembly relative to the solenoid coil during the braking pulse, which generates an electromotive force in the coil.

In particular, it appears that the duration of collapse of the coil voltage, respectively of regulator off-time, is inversely-proportional to the closing velocity of the injector pintle. As it will be understood, calibration efforts permit either determining a mathematical formula to calculate the pintle velocity corresponding to a certain determined duration of extended voltage collapse. Alternatively, one may build a correspondence table of voltage collapse duration, respectively off-time duration, vs. pintle velocity.

The above method may advantageously be implemented in a closed-loop control of fuel injectors. Hence, according to another aspect of the present invention, a method of operating a solenoid fuel injector in an internal combustion engine is proposed. The method comprises performing an injection event including: an injection phase during which the injector solenoid coil is energized for a predetermined time period, so as to perform an opening stroke of the pintle assembly; and a braking phase, performed during the closing stroke of the pintle assembly, during which an injector driver is operated in current regulator mode according to a braking current profile to establish a braking current in the solenoid coil.

The pintle velocity during the closing stroke is determined as described above, and the braking current profile is adapted depending on the determined pintle velocity.

In practice, the braking current profile may adapted in case the pintle velocity does not meet a predetermined range or threshold.

Adapting the braking current profile preferably involves modifying at least one of an amplitude, a duration and a trigger timing, which are the basic parameters that determine the braking current profile.

Preferably, the braking current profile is mapped in function of fuel pressure, preferably the fuel injection pressure of the preceding injection pulse. Indeed, fuel pressure is the main parameter affecting the closing speed.

The present methods are applicable to a variety of fuel injector designs with solenoid actuators and for various fuels. As it will be explained below, their use in fuel injection control methods allows controlling and reducing the pintle speed and hence controlling pintle impact and bouncing. It thus permits to more adequately control the fueling, by suppressing bouncing, while at the same time reaching controlled landing speeds to reduce wear. Although this can be of advantage with any type solenoid injector, the present method proves particularly interesting for application in gaseous fuel injectors that are very sensitive to wear due to the poor lubrication of such fuels.

According to a further aspect, a control unit of a fuel injector system comprising at least one solenoid fuel injector connected to a fuel supply line as well as a fuel injector driver stage with current regulator, may be configured to perform the above method of operating a solenoid fuel injector.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
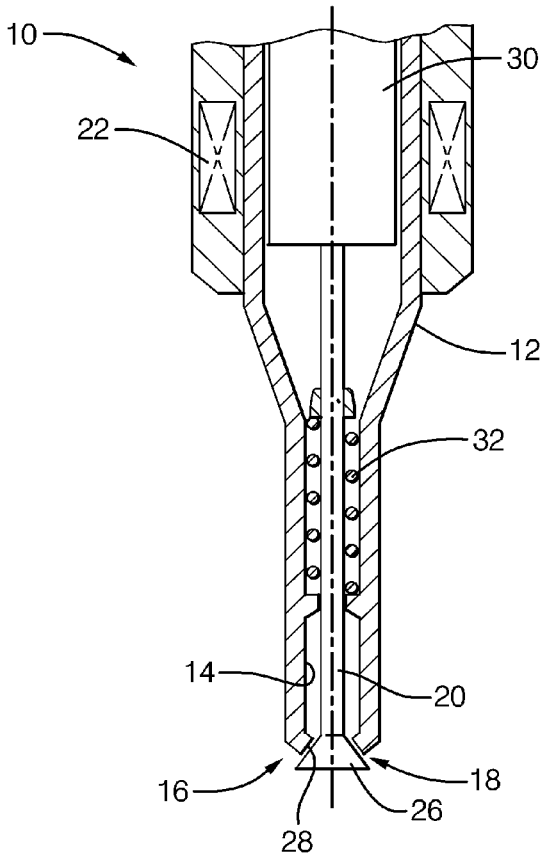
FIG. 1: is a principle diagram of a conventional solenoid fuel injector.

FIG. 1 generally illustrates a conventional solenoid actuated fuel injector 10 comprising a cylindrical tubular body 12 having a central feed channel 14, which performs the function of a fuel duct and ends with an injector tip 16 having an outlet orifice 18 controlled by a pintle assembly 20 (also simply referred to as needle or pintle) operated by an electromagnetic, solenoid actuator 22. The pintle 20 has a rod-shaped body axially guided in the injector body 12 and acts as plunger. The pintle 20 has a sealing head 26 adapted to cooperate with a sealing seat 28 surrounding the orifice 18 in the injector tip 16. At its other end, the pintle 20 cooperates with an armature 30 of the solenoid actuator that causes displacement of the pintle 24 by the action of the solenoid 22 between a closed position and an open position off the sealing seat 28 at the injector tip 16. As it is well known, the armature 30 is set in motion by the electromagnetic field generated by the solenoid coil 22, when energized. For this purpose, the armature 30 pushes onto the pintle 20. No rigid connection is required between the armature and pintle, although such connection may exist.

As it will appear from FIG. 1, the present injector 10 is of the outward opening type. Selective energizing of the solenoid coil 22 thus pushes the pintle in opening direction (downward with respect to FIG. 1) and hence allows lifting the pintle off its seat 28 to perform fuel injection. Reference sign 32 indicates a return spring that tends to hold the pintle 20 in the closed position and forces the pintle 20 towards the sealing seat 28 when open.

Preferred embodiments of the present methods will now be explained with reference to FIG. 2. As it is well known in the art, in conventional engine management strategies a fuel command pulse width is determined for each injection event in an engine cycle; the pulse width corresponds to the duration of the injection. Pulse widths are typically mapped in function of fuel amounts, the latter depending on the requested torque. These aspects are well-known in the art and will not be further detailed herein.

Hence, for any fuel injection event to be performed a pulse width is generated to command a corresponding injector opening duration in order to deliver a predetermined fuel amount. An injector driver stage is thus operatively connected to each fuel injector and configured to deliver to each of them the power required to open the injector for a duration corresponding to the pulse width.

Figure 2:
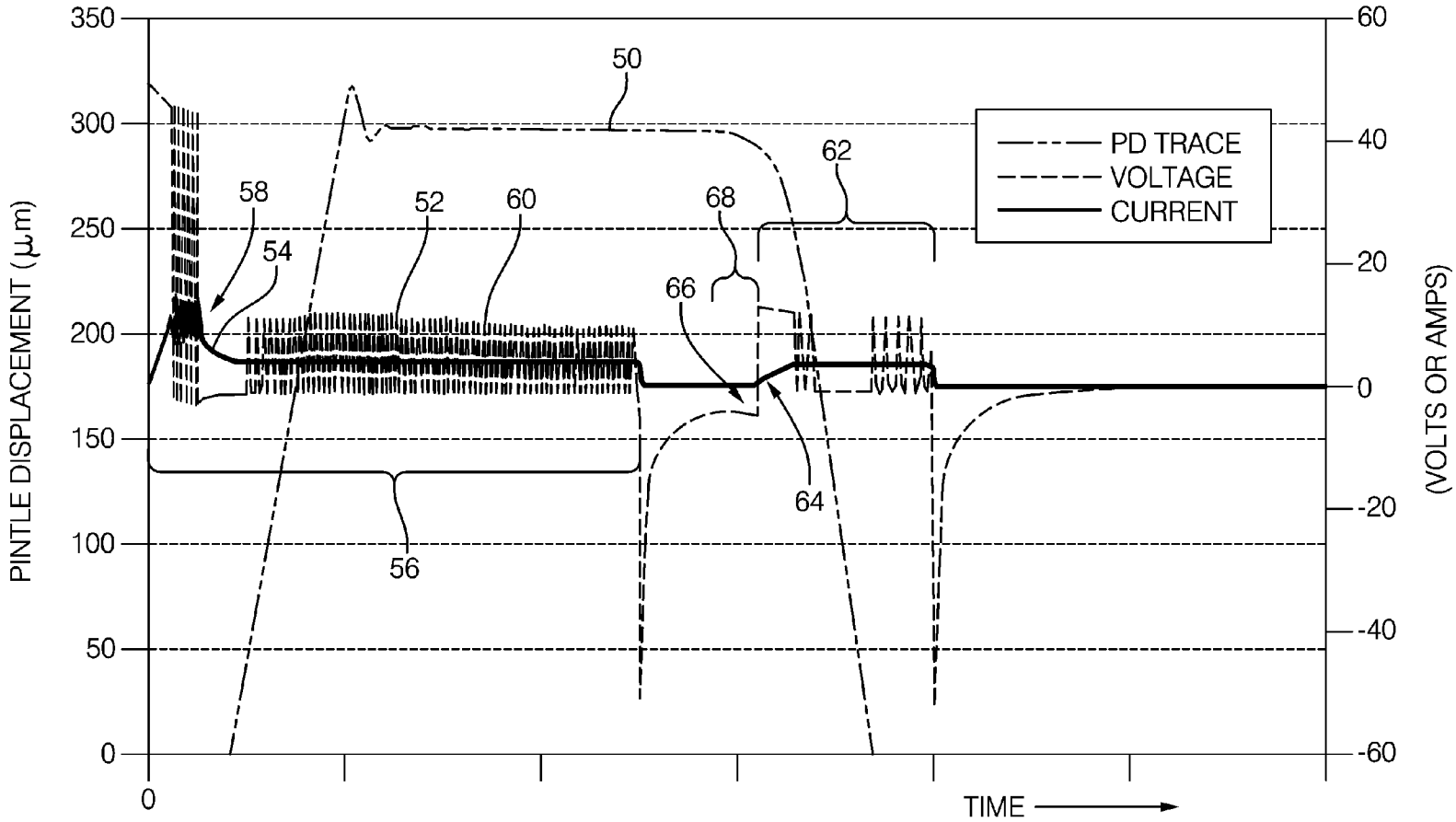
FIG. 2: is a graph illustrating the pintle displacement during an actuating event, as well as the corresponding voltage and current across the solenoid coil.

This is illustrated in FIG. 2, which is a graph showing the injector pintle stroke (trace 50) as well as the voltage (trace 52) and current (trace 54) as measured across the solenoid coil (while connected to the current regulator) vs. time. Bracket 56 indicates a main injection pulse of a fuel injection event. To perform such main injection pulse, the driver stage first establishes an opening current 58 in the solenoid coil, as required to first lift the pintle off its seat. Then a lower, hold current 60 is established in the solenoid coil to maintain it in open position.

The injector driver stage features a current regulator module that regulates the load current through the injector coil by chopping to maintain the load current at a desired average, in this case the opening current and hold current. This chopped regulation may typically be based on a logic signal such as a pulse-width modulated (PWM) signal, or more generally a "chopper signal". The PWM signal first powers the injector coil by switching the driver stage so as to connect the injector to a voltage source. When the coil current reaches an upper threshold $I_{th_up}$, the PWM signal turns the switch off, shutting off power supply to the injector and allowing the coil current to fall until it reaches a lower current threshold $I_{th_low}$. This process is repeated as needed, depending on the command pulse width corresponding to the main injection pulse. Such current regulators are widely employed and their operating mode well-known, hence they will not be further detailed herein.

Operation under such current regulator mode can be observed in FIG. 2, where the oscillations of the voltage trace 52 also reflects the switching due to the PWM signal.

Classically, the pintle starts its opening stroke (see trace 50) with a certain time lag, referred to as opening delay, after the beginning of the main pulse. The closing stroke of the pintle starts also with a certain lag after the end of the main pulse. And there is hence another lag between the end of the main pulse and the actual closure of the injector, i.e. when the pintle rests on its seat without bouncing.

In order to avoid bouncing of the pintle on its seat and achieve a soft landing of the pintle on the valve seat, it is known to perform a braking step/phase by establishing a braking current in the solenoid coil to brake the pintle on its return path.

In the present method however, a closed-loop control of this braking phase is implemented, which uses as checking parameter the closing velocity of the pintle. The updating of the braking current profile on the basis of the velocity information will be explained below.

Let us first explain how the pintle velocity is determined. Bracket 62 indicates the braking pulse applied during the closing stroke of the pintle, during which a braking current 64 is established in the solenoid coil. Preferably, a braking current profile (with preset parameters such as: trigger timing, intensity and length of the braking pulse) is read from a table in function of the fuel pressure. As for the main pulse, during the braking pulse the current regulator of the injector driver stage operates by chopping to maintain the current within a given range corresponding to the desired braking current intensity. The coil is first connected to the voltage source and as soon as the coil current reaches the upper voltage threshold $I'_{th_up}$, the PWM signal switches the power off. When the coil current drops to the lower current threshold $I'_{th_low}$, the voltage is switched back on. This alternating switching of the coil to the power source is carried out as often as necessary to maintain the braking current during the required braking pulse timing.

It shall be appreciated that once the braking current 64 has been established at the desired level by way of the current regulator, see FIG. 2, the current remains at the desired level for a surprisingly long time period, without switching the coil to the power source. Indeed, in the example of FIG. 2, rapidly after the current has reached the desired braking current level, the voltage collapses and remains at zero during an extended time period, as compared to the normal off time under regulation.

It has been found that the duration of this extended off-time of the current regulator, when the voltage is null (zero), depends on the velocity of the pintle along its closing stroke. More particularly, the length of this "extended voltage collapse" appears to be inversely proportional to the pintle velocity.

Figure 4:
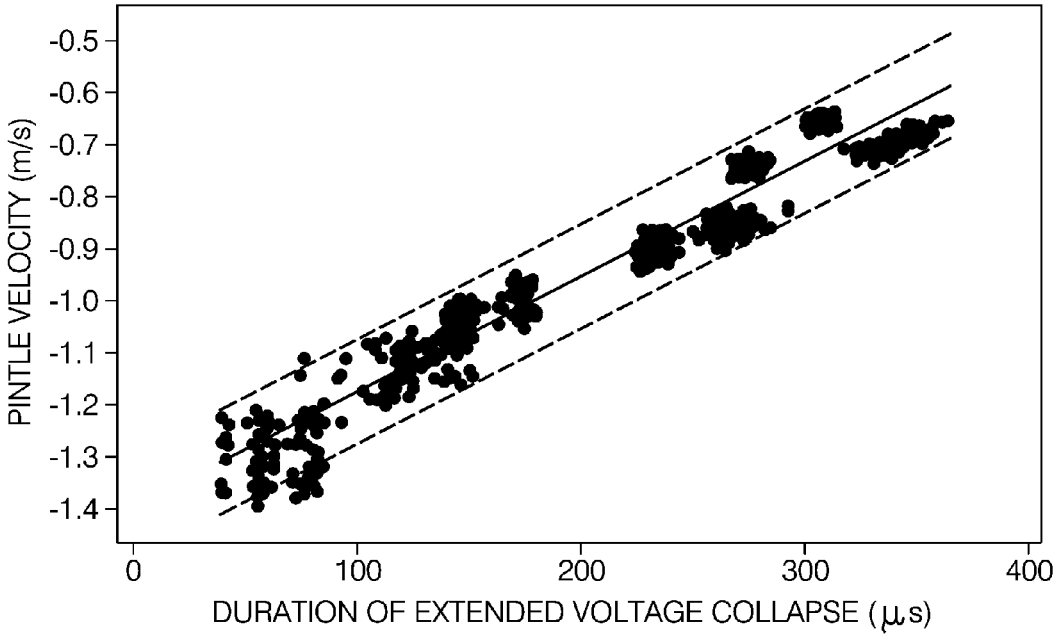
FIG. 4: is a graph illustrating the pintle velocity vs. the length of extended voltage collapse in a braking pulse.

This can be observed in FIG. 4, which shows a graph of the pintle velocity vs. length of extended voltage collapse. As can be seen, there is a substantially linear relationship, where the speed decreases as the length of extended voltage collapse increases.

Hence, the pintle speed velocity can be estimated on the basis of this coil voltage collapse (observed while the coil is connected with the active current regulator). In practice, a mathematical relationship can be memorized in the engine ECU to calculate the pintle velocity on the basis of the determined duration of extended voltage collapse. Alternatively a lookup table may contain a range of voltage collapse durations together with the corresponding speed velocities, and it then suffices to read pintle speeds from the table.

The reason for this voltage collapse arises due to the displacement of the pintle assembly relative to the solenoid coil during the braking pulse. The current in the coil results from the difference between the applied voltage and the electromotive force (called back-emf) generated by the motion of the pintle assembly. Let us consider the following equations:

$$U=E+R*I$$

$$E=K*v$$

Where U and I are the voltage and current across the coil, R the coil resistance. E is the back electromotive force, and as can be seen is proportional to the pintle velocity v.

Therefore, for a given current setpoint, the higher the pintle velocity, the higher this back-emf and therefore one needs to increase the applied voltage to reach the desired current setpoint. Conversely, for a small pintle velocity, the back-emf will be low, and in this case one will need to decrease the applied voltage to reach the desired current setpoint.

In a practical variant, the coil voltage may be monitored to measure the length of each time period when the voltage is null during the braking phase (as prescribed by the braking current profile length), and the greatest time period will then be used as the duration of extended voltage collapse indicative of the pintle velocity.

Figure 3:
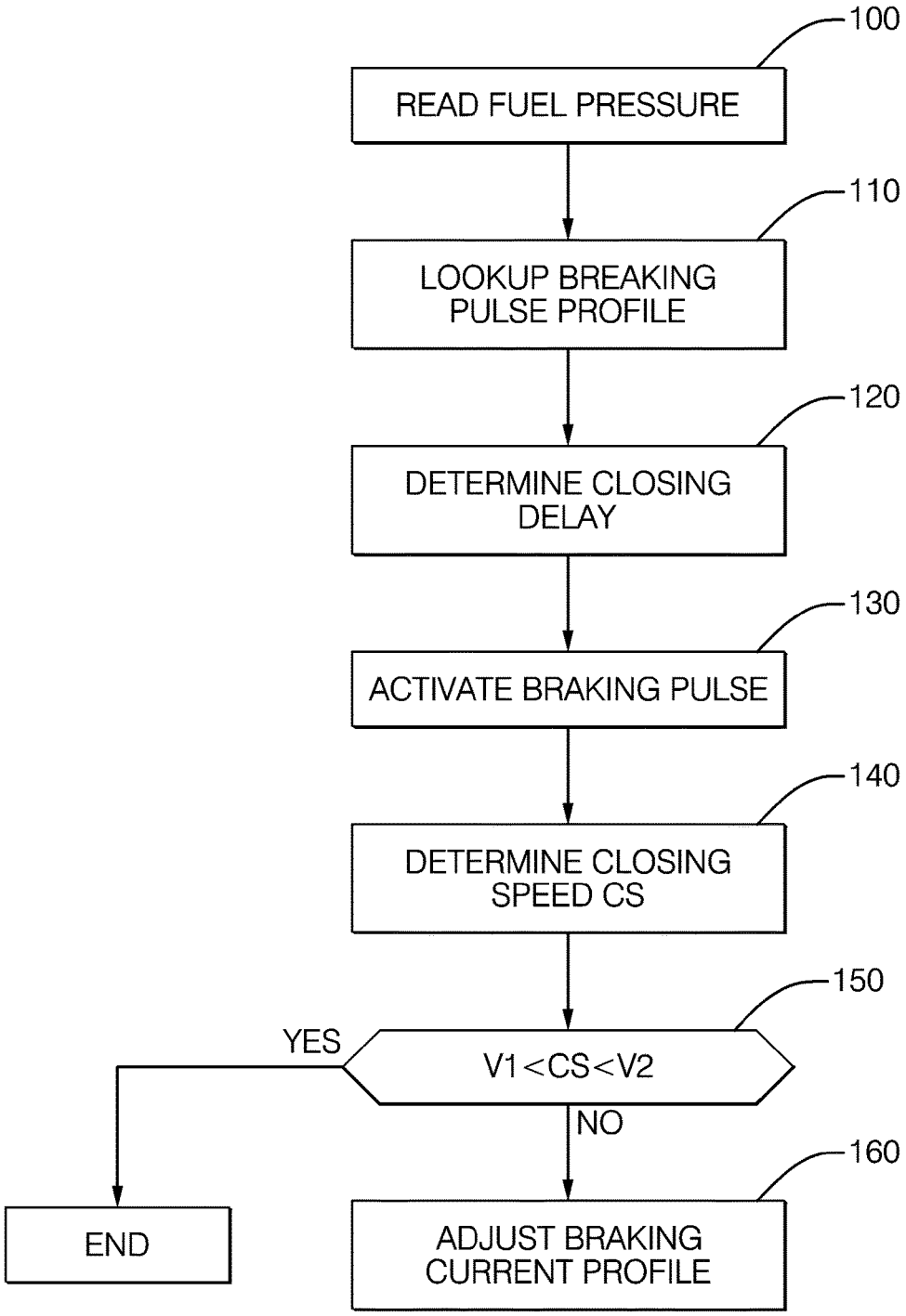
FIG. 3: is a flow chart illustrating one embodiment of a method of operating a fuel injector using the present method for determining the pintle closing velocity.

The so-determined pintle velocity information can advantageously be used in engine management for controlling the fuel injector. A preferred embodiment of the present method for controlling a fuel injector will now be described in more detail with respect to FIGS. 2 and 3. As explained above, a fuel injection event comprises typically at least one main fuel injection, which is operated through generation of a main injection pulse by the ECU. The injector driver stage operates the fuel injector to open during a corresponding length.

In order to brake the pintle on its closing stroke, a braking pulse is performed as explained above. The pintle speed is determined during said braking pulse, and used in a closed loop regulation to control and improve the performance of this braking pulse.

As evoked above, there may typically be three parameters of interest as concerns the braking current profile applied during the braking pulse: the braking current intensity (amplitude/level), the starting or triggering timing of the braking pulse and, to a lesser extent, the duration of the braking current.

Obviously, the braking pulse is to be performed while the pintle is moving, i.e. after it has left its opening position. Due to the pintle response time, the closing stroke starts with a certain time lag after the end of the main pulse. Therefore, in the present method the moment when the pintle starts moving towards its seat (named "closing delay") is preferably detected, and the trigger time for the braking pulse is determined with respect to the closing delay. In the following, this time period between the closing delay and the beginning of the braking pulse is referred to as "inter-pulse delay".

Preferably, the timing at which the pintle leaves its opening position and starts moving is derived from the coil voltage. More precisely, this timing is determined as the moment when, after the end of the main pulse, the rate of variation of the voltage is substantially null ($dv/dt \approx 0$). However, any other appropriate method may be used. In FIG. 2, the so-determined closing delay is indicated by arrow 66 and the inter-pulse delay by bracket 68.

This being said, the closed loop control of the braking pulse may be operated as follows. For each braking pulse to be performed, the fuel pressure is first read (box 100 in FIG.

3) and based on said fuel pressure information a corresponding braking current profile with preset parameters is retrieved from a table, as indicated in box 110. Next, the setting into motion of the pintle is detected at 120, preferably on the basis of the rate of variation of the coil voltage after the end of the second pulse, as explained above. The detection of the closing delay then triggers the inter-pulse delay timer, at the expiry of which the braking pulse is triggered in turn, box 130. In other words, the inter-pulse delay represents the trigger time of the braking pulse.

The pintle velocity CS is then determined at 140, and compared to a calibrated velocity range as indicated in diamond 150. If the closing velocity lies within the calibrated range, it is considered to be satisfactory for a soft landing of the pintle; no adjustment is needed.

In case the determined pintle velocity falls out of the calibrated range, a parameter of the braking current profile is adapted as indicated at 160. As mentioned above, amplitude, trigger time and length are possible variables. In practice, adjusting the trigger time has proved to be satisfactory. As explained above, and accordingly, box 160 may imply updating trigger time, respectively the inter-pulse delay, with a corrected value in the table from which it was read in step 110.

This control algorithm of FIG. 3 will be performed again with the next injection pulse to check the pintle speed and possibly correct the braking current, if required.

The invention claimed is:

1. Method of determining the velocity of a pintle assembly in a solenoid fuel injector during a closing stroke of said pintle assembly, wherein a braking step is performed during said closing stroke, which comprises operating an injector driver with a current regulator to establish a braking current in the solenoid coil;

wherein the velocity of the pintle assembly is derived from the duty-cycle of the current regulator during said braking step; and wherein the velocity of the pintle assembly is estimated on the basis of a collapse duration of the solenoid coil voltage during said braking step.

2. Method according to claim 1, wherein said collapse duration is determined, by monitoring the coil voltage, as the maximum duration of voltage collapse during said braking step.

3. Method according to claim 2, wherein said pintle velocity is estimated by way of an inverse-proportionality rule relative to said maximum duration of collapse of the solenoid coil voltage during said braking step.

4. Method according to claim 2, wherein said pintle velocity is read from a table mapping the pintle velocity in function of the duration of voltage collapse of the solenoid coil during said braking step.

5. Method according to claim 1, wherein said current regulator receives a logic signal triggering the switching of a voltage source of said injector driver; and wherein the velocity of said pintle assembly is determined on the basis of the off-time duration of said voltage source during said braking step.

6. Method of operating a solenoid fuel injector in an internal combustion engine, comprising performing an injection event including: an injection phase during which the injector solenoid coil is energized for a predetermined time period, so as to perform an opening stroke of the pintle assembly; and a braking step, performed during a closing stroke of said pintle assembly, during which an injector driver with a current regulator is operated in current regulator mode according to a braking current profile to establish a braking current in the solenoid coil;

wherein said method comprises the step of determining the pintle velocity during said closing stroke and adapting said braking current profile depending on the determined pintle velocity;

wherein the velocity of the pintle assembly is derived from the duty-cycle of the current regulator during said braking step; and wherein the velocity of the pintle assembly is estimated on the basis of a collapse duration of the solenoid coil voltage during said braking step.

7. Method according to claim 6, wherein the braking current profile is adapted in case the pintle velocity does not meet a predetermined range or threshold.

8. Method according to claim 6, wherein adapting said braking current profile comprises modifying at least one of an amplitude, a duration and a trigger timing.

9. Method according to claim 8, wherein said trigger timing corresponds to the expiry of an inter-pulse delay timer starting at the moment said pintle assembly begins its closing stroke.

10. Method according to claim 9, wherein the beginning of the closing stroke is determined from the solenoid coil voltage as the moment after the injection phase when the derivative of the solenoid coil voltage over time is null.

11. Method according to claim 6, wherein the braking current profile is mapped in function of fuel pressure.

12. Method according to claim 6, wherein said current regulator is configured to maintain the solenoid coil current within a predetermined range.

13. Fuel injector system comprising at least one solenoid fuel injector connected to a fuel supply line, a fuel injector driver stage with current regulator and a control unit, wherein said control unit is configured to perform a method comprising performing an injection event comprising:

an injection phase during which the injector solenoid coil is energized for a predetermined time period, so as to perform an opening stroke of the pintle assembly; and a braking step, performed during a closing stroke of said pintle assembly, during which an injector driver with a current regulator is operated in current regulator mode according to a braking current profile to establish a braking current in the solenoid coil;

wherein said method comprises the step of determining the pintle velocity during said closing stroke and adapting said braking current profile depending on the determined pintle velocity;

wherein the velocity of the pintle assembly is derived from the duty-cycle of the current regulator during said braking step; and wherein the velocity of the pintle assembly is estimated on the basis of a collapse duration of the solenoid coil voltage during said braking step.

14. Method according to claim 1 wherein said solenoid fuel injector is a gaseous fuel solenoid fuel injector.

15. Method according to claim 6 wherein said collapse duration is determined, by monitoring the coil voltage, as the maximum duration of voltage collapse during said braking step.

16. Method according to claim 15, wherein said pintle velocity is estimated by way of an inverse-proportionality rule relative to said maximum duration of collapse of the solenoid coil voltage during said braking step.

17. Method according to claim 15, wherein said pintle velocity is read from a table mapping the pintle velocity in function of the duration of voltage collapse of the solenoid coil during said braking step.

18. Method according to claim 6, wherein said current regulator receives a logic signal triggering the switching of a voltage source of said injector driver; and wherein the velocity of said pintle assembly is determined on the basis of the off-time duration of said voltage source during said braking step.

19. Method according to claim 6, wherein the braking current profile is mapped in function of the fuel injection pressure of the preceding injection pulse.

* * * * *